US010573113B2

(12) United States Patent
Derks et al.

(10) Patent No.: US 10,573,113 B2
(45) Date of Patent: Feb. 25, 2020

(54) DEVICE AND METHOD FOR CHECKING VALUE DOCUMENTS FOR MARKING INK

(71) Applicant: GIESECKE+DEVRIENT CURRENCY TECHNOLOGY GMBH, Munich (DE)

(72) Inventors: Hendrik Derks, Geretsried (DE); Jan Domke, Vaterstetten (DE); Johannes Feulner, Munich (DE); Norbert Holl, Germering (DE); Steffen Schmalz, Munich (DE); Dieter Stein, Holzkirchen (DE); Stefan Kokrhoun, Grobenzell (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 2 days.

(21) Appl. No.: 16/092,520

(22) PCT Filed: Apr. 10, 2017

(86) PCT No.: PCT/EP2017/000471
§ 371 (c)(1),
(2) Date: Oct. 10, 2018

(87) PCT Pub. No.: WO2017/178111
PCT Pub. Date: Oct. 19, 2017

(65) Prior Publication Data

US 2019/0164372 A1 May 30, 2019

(30) Foreign Application Priority Data

Apr. 11, 2016 (DE) ..... 10 2016 004 353

(51) Int. Cl.
*G07D 7/06* (2006.01)
*G07D 7/08* (2006.01)
(Continued)

(52) U.S. Cl.
CPC ..... *G07D 7/06* (2013.01); *G07D 7/08* (2013.01); *G07D 7/12* (2013.01); *G07D 7/1205* (2017.05);
(Continued)

(58) Field of Classification Search
CPC ..... G07D 2207/00; G07D 7/06; G07D 7/08; G07D 7/12; G07D 7/1205; G07D 7/16; G07D 7/164
See application file for complete search history.

(56) References Cited

U.S. PATENT DOCUMENTS 7,607,528 B2 10/2009 Derks et al.
9,165,336 B2 10/2015 Scholz et al.
(Continued)

FOREIGN PATENT DOCUMENTS

DE 10259288 A1 7/2004
DE 102009057348 A1 6/2010
(Continued)

OTHER PUBLICATIONS

German Search Report from DE Application No. 102016004353.9, dated Dec. 12, 2016.
(Continued)

*Primary Examiner* — Hina F Ayub
(74) *Attorney, Agent, or Firm* — Workman Nydegger

(57) ABSTRACT

An apparatus and a corresponding method for checking value documents, involves at least one first sensor configured to detect electromagnetic radiation reflected and/or transmitted by a value document and to convert the radiation into corresponding first sensor signals. At least one second sensor is configured to detect sound waves reflected and/or transmitted by the value document and to convert the sound waves into corresponding second sensor signals, and an evaluation device configured to determine a first area value
(Continued)

which characterizes a first area of the value document on the basis of the first sensor signals, to determine a second area value which characterizes a second area of the value document on the basis of the second sensor signals, and to infer a possible identification marking of the value document with a marking ink on the basis of the first and second area value.

11 Claims, 2 Drawing Sheets

(51) Int. Cl.

| | |
|---|---|
| ***G07D 7/16*** | (2016.01) |
| ***G07D 7/12*** | (2016.01) |
| ***G07D 7/1205*** | (2016.01) |
| ***G07D 7/164*** | (2016.01) |

(52) U.S. Cl.
CPC ..... *G07D 7/16* (2013.01); *G07D 7/164* (2013.01); *G07D 2207/00* (2013.01)

(56) References Cited

U.S. PATENT DOCUMENTS

| | | | | |
|---|---|---|---|---|
| 2006/0151282 | A1 | 7/2006 | Derks et al. | |
| 2009/0312957 | A1* | 12/2009 | Domke ..... | G01N 29/0618 702/39 |
| 2010/0060881 | A1 | 3/2010 | Kayani | |
| 2014/0355818 | A1 | 12/2014 | Scholz et al. | |
| 2015/0047945 | A1 | 2/2015 | Kayani | |

FOREIGN PATENT DOCUMENTS

| | | | |
|---|---|---|---|
| DE | 102011121911 | A1 | 6/2013 |
| WO | 2004055740 | A2 | 7/2004 |

OTHER PUBLICATIONS

International Search Report from PCT Application No. PCT/EP2017/000471, dated Jul. 11, 2017.

* cited by examiner

DEVICE AND METHOD FOR CHECKING VALUE DOCUMENTS FOR MARKING INK

BACKGROUND

The invention relates to an apparatus and a method for checking value documents, in particular banknotes, and to a value document processing system.

In certain cases, banknotes are subsequently supplied with a marking ink. Thus, for example, certain regions of banknotes which are to be withdrawn from cash circulation are marked with a marking ink, in particular blackened, by national financial institutes. Further, marking ink is also used for theft protection, by the marking ink being released in the event of an unauthorized opening of a transport container for banknotes which is supplied with a so-called ink bomb system, so that the banknotes are wetted with the ink.

DE 10 2009 057 348 A1 discloses an apparatus for automatically recognizing banknotes marked with marking ink, wherein at least one of the surfaces of the banknote to be checked is detected with at least one sensor, and the presence of marking ink is checked on the basis of the data obtained from an edge region of the surface of the banknote.

In the known methods for checking banknotes it can occur that regions of a banknote supplied with marking ink cannot be distinguished with sufficient reliability from regions which are bent over or have dog-ears, so that these banknotes are incorrectly classified as being marked with a marking ink and are thus unintentionally removed from cash circulation, although these could have been returned into circulation.

SUMMARY

It is the object of the present invention to specify an apparatus, a method and a value document processing system which permit(s) an as reliable as possible recognition of an identification marking of value documents, in particular banknotes, with a marking ink.

The apparatus according to the invention for checking value documents, in particular banknotes, has at least one first sensor and at least one second sensor. The at least one first sensor is preferably configured as an optical sensor and is adapted to detect electromagnetic radiation reflected and/or transmitted by a value document and to convert said radiation into corresponding first sensor signals. The at least one second sensor is preferably configured as an ultrasonic sensor and is adapted to detect sound waves, in particular ultrasonic waves, reflected and/or transmitted by the value document, and to convert said sound waves into corresponding second sensor signals. In addition, the apparatus has an evaluation device which is configured to determine on the basis of the first sensor signals a first area value characterizing a first area of the value document, to determine on the basis of the second sensor signals a second area value characterizing a second area of the value document, and to infer a possible identification marking of the value document with a marking ink on the basis of the first and the second area value.

The value document processing system according to the invention has at least one apparatus for processing, in particular for conveying and/or counting and/or sorting, of value documents, in particular banknotes, and an apparatus according to the invention.

In the method according to the invention for checking value documents, in particular banknotes, electromagnetic radiation reflected and/or transmitted by a value document is detected and converted into corresponding first sensor signals. Further, sound waves, in particular ultrasonic waves, reflected and/or transmitted by the value document are detected and converted into corresponding second sensor signals. Based on the first sensor signals, a first area value is determined, which characterizes a first area of the value document. Based on the second sensor signals, a second area value is determined, which characterizes a second area of the value document. Finally, it is determined on the basis of the first and the second area value whether the value document is possibly marked with a marking ink.

The invention is based on the approach of determining the area of the value document to be checked with the aid of an optical sensor and an acoustic sensor, in particular an ultrasonic sensor, and, in the event of a difference between the respectively determined areas, to infer a possible identification marking of the value document with marking ink. For this purpose, a first area value is determined on the basis of first sensor signals of an optical sensor, which detects the electromagnetic radiation reflected and/or transmitted by the value document. Further, a second area value is determined on the basis of second sensor signals of an ultrasonic sensor, which detects the ultrasonic waves reflected and/or transmitted by the value document. The respectively determined area values characterize for example the size and/or the format of the area of the value document. The ultrasonic sensor reliably detects the ultrasonic waves reflected and/or transmitted from the entire area of the value document, independently of any coloration of the value document with marking ink, since the reflectance or transmissivity of the value document for ultrasonic waves is not influenced or only slightly influenced by the marking ink. The second area value determined on the basis of the second sensor signals therefore corresponds to the actual area of the value document. For the optical sensor, in contrast, partial areas of the value document colored with marking ink are not visible or cannot be distinguished from the dark background of the value document, since the reflectance and/or transmissivity of the value document for electromagnetic radiation is generally strongly influenced, in particular suppressed or at least reduced, by the marking ink. In the case of edge regions of the value document colored, in particular blackened, with marking ink, the first area value determined on the basis of the first sensor signals is smaller than the actual size of the value paper area.

If the determined first and second area values do not match or if a predetermined value for an area difference is exceeded, a possible identification marking of the value document with marking ink can be inferred, wherein the value document can be classified as a value document marked with marking ink or preliminarily as a value document possibly marked with marking ink. In the latter case, it can be provided that for the definitive classification as a value document marked with marking ink, said document is subjected to one or several further checks and a final classification is effected only in dependence on the result of the checks.

With the approach according to the invention, it is possible to prevent that value documents with bent-over areas or dog-ears, which generally cannot be distinguished either from the dark background by the optical sensor, are incorrectly classified as value documents marked with a marking ink, since a bent-over region or a dog-ear reduces both the first area value and the second area value in the same manner, so that no significant difference can be ascertained between the first and the second area value.

Overall, the invention thus allows reliable recognition of value documents marked with a marking ink.

The at least one first sensor is preferably configured as a spatially resolving sensor, for example as a surface camera or line camera, wherein electromagnetic radiation, which is reflected and/or transmitted at different points of the value paper, is converted into corresponding first sensor signals. Preferably, the second sensor is also configured as a spatially resolving sensor, which detects the ultrasonic waves reflected and/or transmitted by the value document in a spatially resolved manner.

In a preferred embodiment, the evaluation device is configured to infer an identification marking of the value document with a marking ink when the difference between the second area value and the first area value exceeds a predetermined first value. This is a particularly simple manner in order to infer an identification marking of the value document with a marking ink from the first and second area values. The predetermined first value is preferably higher than, in particular at least twice as high, as the accuracy, for example the standard deviation or the variance, with which the first and/or second area value can be determined from the first and/or second sensor signals. This ensures that a possible identification marking of a value document with marking ink is reliably recognized.

In a further preferred embodiment, the evaluation device is configured to infer an identification marking of the value document with a marking ink when the quotient of the second area value and the first area value exceeds a predetermined second value. Analogously to the above-described embodiment, in the selection of the predetermined second value, the accuracy, for example the variance or standard deviation, likewise can be taken into account in the determination of the first and/or second area value. This also ensures that a possible identification marking of a value document with marking ink is reliably detected.

In a further preferred embodiment, the evaluation device is configured to infer an identification marking of the value document with a marking ink when a relative deviation of the second area value from the first area value exceeds a predetermined third value. In the selection of the predetermined third value, measurement inaccuracies preferably can be taken into account likewise in the determination of the first and/or second area value. It is particularly preferred that the predetermined third value is higher than or equal to 4%. In this case, the value document is classified as possibly marked with a marking ink when the second area value is at least 4% higher than the first area value. As a result, the check of a value document with reference to a possible marking with marking ink is particularly reliable.

In a further preferred embodiment, the evaluation device is configured to predetermine the first, second and/or third value in dependence on the denomination, i.e. the nominal value, of the value document. As a result, in the check of value documents it is taken into account with regard to an identification marking with marking ink that the absolute and/or relative size of the areas of the value documents marked with marking ink can be dependent on the respective denomination. The reliability of the check of a value document with regard to a possible identification marking with marking ink is increased further thereby.

In a further preferred embodiment, the evaluation device is configured to infer a possible identification marking of the value document with marking ink on the basis of first sensor signals, which are obtained from the electromagnetic radiation reflected and/or transmitted in at least one edge region of the value document. This check is preferably effected when the identification marking of the value document with marking ink cannot or not sufficiently reliably be inferred on the basis of the first and second area values alone. The effort for evaluating the corresponding sensor signals is reduced by limiting the check to at least one edge region. At the same time, the limitation to the at least one edge region is generally sufficient, since the marking ink, in particular in the case of a marking by means of a so-called ink bomb system, is usually located at the edges of the value documents.

In a further preferred embodiment, the evaluation device is configured to infer an identification marking of the value document with marking ink on the basis of first sensor signals, which are obtained from the electromagnetic radiation reflected and/or transmitted in at least one predetermined region of the value document. The at least one predetermined region is selected in particular such that it does not contain any regions of the value document in which certain security elements, in particular holographic security elements, for example patches or LEAD strips, are present.

Preferably, the above-described check of the value document is effected when it is impossible or not possible with sufficient reliability to infer an identification marking of the value document with marking ink on the basis of the first and second area values and/or in the above-described evaluation of the at least one edge region of the value document.

In a further preferred embodiment, the evaluation device is configured to predetermine the at least one predetermined region in dependence on the denomination of the value document. This ensures that regions which are not suitable in the check of the value document with regard to an identification marking with marking ink are not taken into account in the evaluation of the first sensor signals. The reliability of the check of value documents with regard to an identification marking with marking ink is further increased as a result.

In a further preferred embodiment, the apparatus has one or several transport elements, in particular transport belts, which are configured to transport the value document relative to the second sensor. Here, the transport elements can cover one or several first regions of the value document. The evaluation device is preferably configured to determine by estimation the second area value on the basis of second sensor signals, which are obtained from the sound waves reflected and/or transmitted in one or several second regions of the value document which are not covered by the transport elements. Here, the area of the covered first regions is estimated and the second area value of the value document is finally determined therefrom on the basis of the image information from the second regions which are not covered by the transport elements. A reliable check of the value documents on the basis of the first and second area values is thus also possible when parts of the value document are covered by transport elements during the detection of an image of the value document by means of ultrasound.

In a further preferred embodiment, the at least one first sensor is configured to detect electromagnetic radiation in the infrared range of the spectrum and convert said radiation into corresponding first sensor signals.

In a further preferred embodiment, the evaluation device is configured to combine, for example average, the first area values determined independently of one another on the basis of first sensor signals of more than one first sensor.

In a further preferred embodiment, the evaluation device is configured to determine on the basis of the first and/or second sensor signals whether a value document to be checked is present at all in the measurement window, i.e. in the region from which first and/or second sensor signals are detected, for example a field of view of a camera. The first and/or second area value is preferably employed for this purpose, wherein an empty measurement window is indicated in particular by a first and/or second area value of 0 or almost 0 or a first and/or second area value which is smaller than a fourth predetermined value.

In a further preferred embodiment, the evaluation device is configured to determine on the basis of the first and/or second sensor signals whether overlapping removals of value documents are possibly present, i.e. mutually overlapping value documents or layers of value documents, in particular whether parts of the value documents, in particular corners, project out of the measurement window. Preferably, the y coordinates of the corner points of the value documents in the coordinate system of the at least one first and/or second sensor, i.e. of the corresponding measurement window, are determined by means of image processing methods for this purpose.

Further, the evaluation device is preferably configured to determine whether overlapping removals which do not protrude out of the measurement window and/or folded banknotes are present. Preferably, second sensor signals are employed for this purpose, which were obtained by detecting transmitted sound waves, in particular ultrasonic waves, since the second sensor signals are in particular a measure of the thickness of the present value document or documents. An overlapping removal is present, for example, when more than four corners were determined and at least a first thickness and a second thickness were determined based on the second sensor signals, wherein the second thickness is in particular twice as high as the first thickness. In this case, the second thickness marks the region in which the value documents overlap.

BRIEF DESCRIPTION OF THE DRAWINGS

Further advantages, features and application possibilities of the present invention will result from the following description in connection with the figures. There are shown.

DETAILED DESCRIPTION OF VARIOUS EMBODIMENTS

Figure 1:
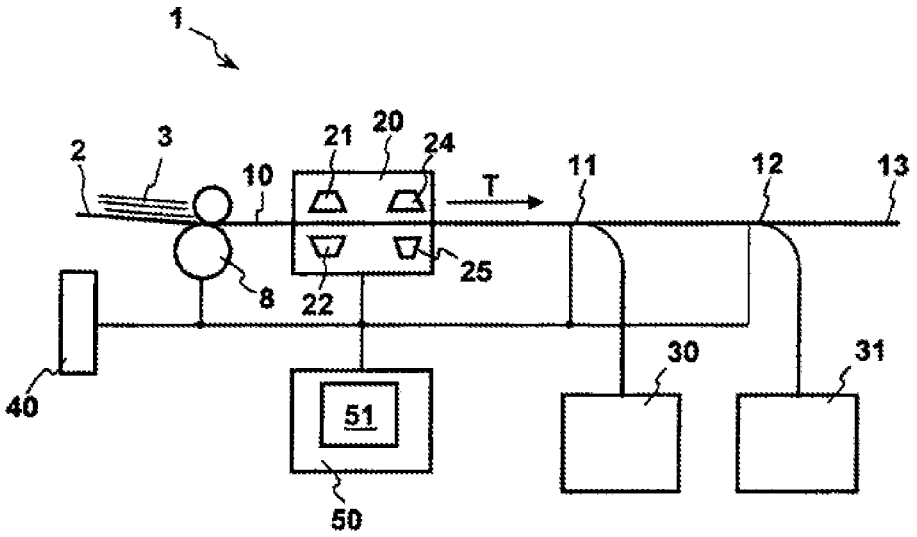
FIG. 1 an example of a structure of a value document processing system in a schematic representation.

FIG. 1 shows an example of a schematic structure of a value document processing system 1 having an input pocket 2, in which a stack of value documents to be processed, in particular banknotes 3, is supplied, and a singler 8, by which the respectively lowermost banknote of the input stack is grasped and is transferred to a transport device 10—only schematically reproduced in the selected representation—, which conveys the banknote in the transport direction T to a sensor device 20.

In the example shown, the sensor device 20 comprises a first sensor 21 and a further first sensor 22, which are each preferably configured as a so-called line camera or surface camera and, by means of sensor elements arranged along a line or area, in spatially resolved manner detect light emanating from the banknote, in particular in the visible and/or infrared and/or ultraviolet spectral range and convert said light into corresponding sensor signals.

In the example shown, the first sensor 21 detects the light emitted by a radiation source (not shown) and incident onto the banknote and remitted, i.e. diffusely and/or directionally reflected, by said banknote, and converts said light into corresponding first sensor signals. Accordingly, the further first sensor 22 detects the light remitted, i.e. diffusely and/or directionally reflected, by the back side of the banknote, and converts said light into corresponding further first sensor signals.

The sensor device 20 further comprises a second sensor 24, which is preferably configured as an ultrasonic sensor, and detects ultrasonic waves emanating from an ultrasound source 25, which pass through the banknote, i.e. are transmitted, and converts said ultrasonic waves into corresponding second sensor signals. The second sensor 24 and/or the ultrasound source 25 preferably have piezoelectric elements which are configured to convert incident ultrasonic waves into an alternating voltage and/or an applied alternating voltage into ultrasonic waves. Instead of a conversion into an alternating voltage, in principle any signal suitable for the qualitative and/or quantitative description of the sensor signal can be chosen, for example a mixed voltage, a digital signal, a frequency-modulated signal or an analog DC voltage.

Particularly preferably, the second sensor 24 has a plurality of sensor elements arranged in a row or area, in particular piezoelectric elements, through which the ultrasonic waves passing through the banknote can be detected in a spatially resolved manner.

Preferably, the line extends with the sensor elements of the respective sensor 21, 22 or 24 substantially perpendicularly to the transport direction T of the banknotes, so that during each read-out operation in the respective sensor 21, 22 or 24 a first or second sensor signal profile along the sensor line is obtained, which corresponds to an intensity profile of the light which is remitted or the ultrasonic waves which are transmitted by the banknote in a direction extending perpendicularly to the transport direction T.

The first and second sensor signals generated by the sensors 21, 22 and 24 of the sensor device 20, in particular the corresponding first or second sensor signal profiles, are forwarded to a control device 50 and an evaluation device 51. The evaluation device 51 can be contained in the control device 50, but can also form a unit separate from the control device 50.

In the evaluation device 51, the sensor signals, optionally after a pre-processing, are employed to check the respective banknote, wherein statements about different properties of the banknote are derived from the respective sensor signals, such as, for example, denomination, authenticity, degree of soiling, wear, defects, the presence of foreign objects, such as e.g. adhesive strips, other stickers, paper clips and staples, and in particular the presence of an identification marking or coloring of the banknote with marking ink.

Depending on the properties of the respective banknote determined in the evaluation device 51, the transport apparatus 10 and the switches 11 and 12 along the transport path are controlled by the control device 50 such that the banknote is fed to one of several output pockets 30 and 31 and is stored there. For example, such banknotes are stored in a first output pocket 30 which have been recognized as not marked with a marking ink and, optionally, also fulfill further criteria, for example with regard to authenticity, soiling and fitness, whereas the banknotes classified as marked with a marking ink are stored in a second output pocket 31.

The reference number 13 at the end of the illustrated transport path is intended to indicate that further output pockets and/or other devices, for example for storing banknotes classified as inauthentic, can be provided.

Alternatively, it can be provided that a banknote marked with a marking ink, in particular in the form of a blackening of larger and/or specific areal regions of the banknote, is transferred directly into a shredder (not shown) for destruction or into a manual processing pocket for banknotes suspected of forgery, instead of being transferred into the second output pocket 31.

In the example represented, the value document processing system 1 further comprises an input/output device 40 for inputting data and/or control commands by an operator, for example by means of a keyboard or a touch screen, and outputting or displaying data and/or information relating to the processing process, in particular to the respectively processed banknotes.

The value document processing system 1 shown by way of example is particularly suitable for checking value documents for the presence of an identification marking by marking ink, which is explained in more detail below.

Figure 2:
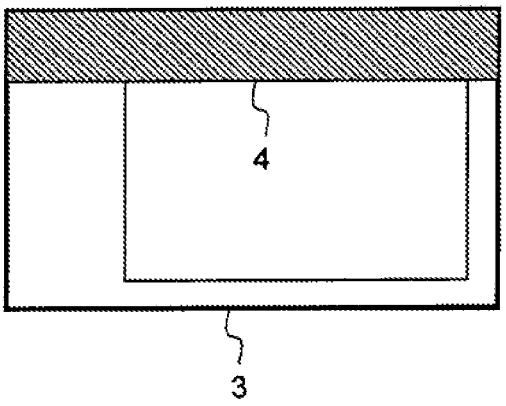
FIGS. 2*a*) and 2*b*) FIG. 2*a*) a first example and FIG. 2*b*) a second example of a value document to be checked in the form of a banknote.

FIG. 2*a*) shows a first example of a value document in the form of a banknote 3—represented only strongly schematically in the present case—, which has been colored with marking ink, in particular blackened, in a region 4 at the upper edge of the banknote 3. In the present example, the blackened region 4 extends over the entire width of the banknote 3. However, the following explanations also apply correspondingly to markings of any size and position on the banknote 3.

When electromagnetic radiation, in particular infrared radiation and/or visible light, is incident on the banknote 3, said radiation is remitted in dependence on the optical properties, such as absorption and scattering, of the banknote, and detected by the first sensors 21 or 22 (see FIG. 1) and converted into corresponding first sensor signals. Here, the electromagnetic radiation incident on the region 4 of the banknote 3 colored with marking ink is not remitted or only slightly remitted, since the marking ink strongly absorbs the incident radiation. A first area value computed on the basis of the corresponding first sensor signals, such as, for example, the size and/or shape of the detected image of the banknote 3, in the present example therefore characterizes a first area which corresponds to the actual area of the banknote 3 minus the region 4 colored with marking ink.

Ultrasonic waves emitted by the ultrasound source 25 (see FIG. 1), on the other hand, are transmitted in the same manner by the entire area of the banknote 3, i.e. in particular also by the region 4 colored with marking ink, so that a second area value determined on the basis of the second sensor signals, such as, for example, the size and/or shape of the detected image of the banknote 3, characterizes the actual area of the banknote 3.

In the present case, the second area value determined on the basis of the ultrasonic sensor signals is thus higher than the first area value determined on the basis of the optical sensor signals.

When a difference between the second and the first area value is determined and/or the difference exceeds a certain predetermined threshold value, thus, the presence of a possible identification marking of the banknote 3 with marking ink can be inferred. A difference between the second and the first area value can be determined, for example, by comparing the determined area values and/or by forming a difference or a quotient of the second and the first area value. Preferably, as a measure for the difference, there is determined the difference between the second and the first area value relative to the second area value, i.e. a relative deviation of the two area values from one another.

For example, it can be provided that a banknote 3 is classified as a banknote 3 possibly marked with marking ink, if the relative deviation of the area values is greater than a predetermined threshold value. Preferred threshold values are between about 2 and 8%. Particularly preferably, the threshold value is about 4%.

Figure 2B:
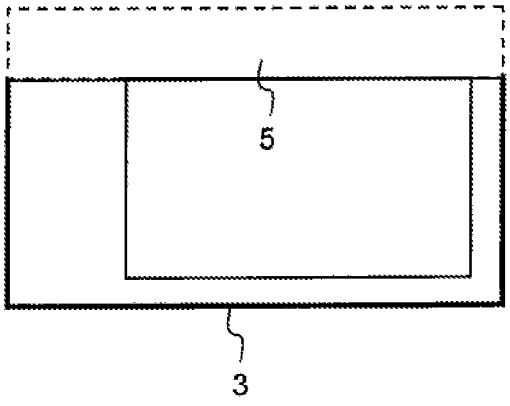

In the second example shown in FIG. 2*b*), the banknote 3 is bent in such a way that a region 5 (dashed) of the banknote 3 is not visible. In this example, a first area value determined on the basis of the first sensor signals characterizes an area which is exactly as large as the area which is characterized by the second area value obtained from the second sensor signals. In this case, the first and second area values are substantially identical, so that the banknote 3 is not incorrectly classified as a banknote colored with a marking ink, such as the banknote 3 in the first example of FIG. 2*a*).

Preferably, here a classification of the banknote 3 as a banknote marked with marking ink is effected only preliminarily, wherein the banknote 3 is initially classified on the basis of the first and second area values only as possibly marked with marking ink and is subjected to one or several further checks, in which the banknote 3 is checked in a different manner for the presence of marking ink and, depending on the result of the check, is then finally classified accordingly. This is preferably effected by checking edge regions of the banknote 3 and/or by means of so-called template matching, in which certain regions of the banknote 3 are subjected to a check. This is explained in more detail below with reference to FIGS. 3 and 4.

Figure 3:
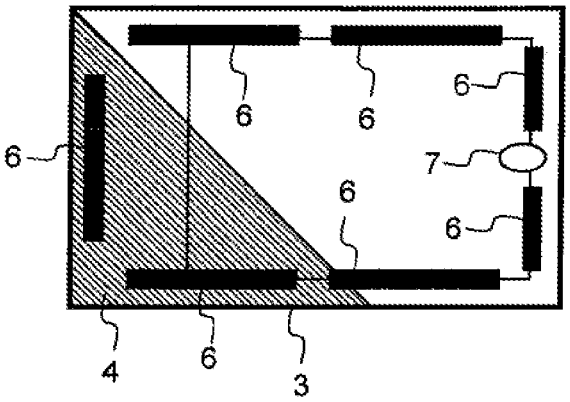
FIG. 3 a first example of a detected image of a banknote.

FIG. 3 shows a first example of an image of a banknote 3 detected with one of the first sensors 21, 22 (see FIG. 1), which banknote is marked with a marking ink in the region 4. Several edge regions 6 are drawn in the reproduced image of the banknote 3, which are checked for the presence of marking ink.

The narrow edge regions 6 are preferably arranged such that their longitudinal sides lie parallel to the edges of the banknote 3. The edge regions 6 are typically located between 1 to 4 mm from the edges and have a width of between about 1 and 3 mm. The edge regions 6 are further preferably arranged such that certain regions of the banknote 3 are left out, such as, for example, security features 7 in the form of holographic elements.

The evaluation device 51 (see FIG. 1) is preferably configured to count a number of first sensor signals in the edge regions 6, said sensor signals lying in a specific signal strength range, and to infer therefrom a possible identification marking of the banknote 3 with marking ink. For example, all image points (pixels) in the respective edge region 6 of the camera image are counted the brightness of which lies between a first brightness value, for example 50, and a second brightness value, for example 800. Thereby image points from the dark background of the banknote, which typically have brightness values of less than 50, and image points from the unblackened banknote, which typically have brightness values of more than 800, are masked out, and only such image points are counted which have a typical brightness for a blackening of the banknote 3.

The above-described check of the edge regions 6 of the banknote 3 is preferably effected when a statement with reference to an identification marking of the banknote 3 with marking ink is impossible or not possible with the required reliability on the basis of the first and second area values alone.

When the presence of an ink marking cannot be inferred or cannot be reliably inferred on the basis of this check either, for example in the case of banknotes where an attempt was made to wash off the marking ink, a further check of the banknote 3 can be provided. Here, images recorded of the banknote 3 are preferably subjected to a so-called template matching, which is explained in more detail below.

Figure 4:
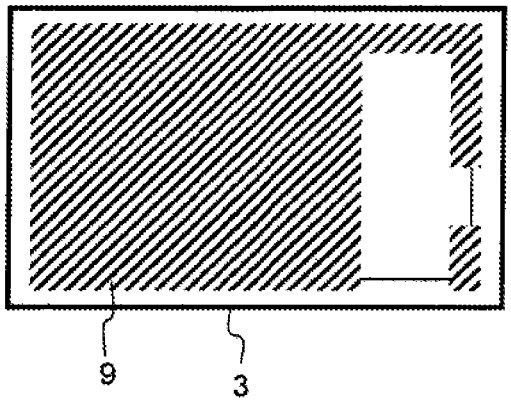
FIG. 4 a second example of a detected image of a banknote.

FIG. 4 shows a second example of an image of a banknote 3 detected with one of the first sensors 21, 22 (see FIG. 1). In this example a hatched region 9 indicates the region in which the electromagnetic radiation remitted by the banknote 3 and detected by the first sensors 21, 22 is evaluated for recognizing an ink marking. Regions of the banknote 3 are left out (represented transparent) from the hatched region 9 which are not suitable for recognizing an ink marking, such as, for example, regions with a dark IR print and/or with a hologram foil (so-called patch, LEAD).

The hatched region 9, which is also referred to as a "mask" or "template", is preferably configured to be denomination-specific, i.e. selected in dependence on the determined nominal value of the banknote 3, and/or to be position-specific, i.e. selected in accordance with the orientation of the banknote 3.

In the present example, preferably all image points (pixels) in the region 9 of the camera image are counted the brightness of which exceeds a predetermined brightness value, such as 1500. In this way, it is ensured that normal soiling and watermarks are not incorrectly identified as an identification marking with marking ink. The number of pixels determined here is compared with a predetermined number, which depends on the size of the area of the region 9. When the determined number falls below the predetermined number, thus, the presence of marking ink in the examined region 9 can be inferred.

Preferably, a percentage match of the determined number to the predetermined number is determined and, on the basis of the result, an identification marking of the banknote 3 with marking ink is inferred.

In order to save computing time, the evaluation device 51 is preferably configured to evaluate only a part of the first sensor signals or image points in the hatched region 9. Preferably, only every third image point is checked with regard to its brightness value with reference to the predetermined threshold value and counted accordingly.

Figure 5:
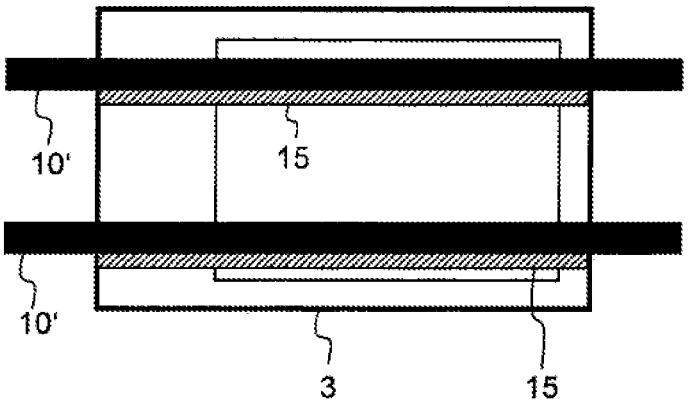
FIG. 5 an example of a banknote located in a sensor device.

FIG. 5 shows an example of a banknote 3 located in the sensor device 20 (see FIG. 1) which is partially covered by transport elements 10', for example transport belts, of the transport device 10. This can be the case, for example, when the value document processing system is constructed as a so-called belt machine.

When the transport elements 10' are located, for example, between the second sensor 24 on the one hand and the banknote 3 or the ultrasound source 25 on the other hand, the image detected by the second sensor 24 does not contain any image information about the banknote 3 in the regions of the transport elements 10'.

In this case, the size and/or shape of the missing image regions are preferably determined by estimation on the basis of the image information from the uncovered regions of the banknote 3. This is achieved, for example, in that second sensor signals or image points from image regions 15 located above and/or below a transport element 10', which were preferably detected with a sensor line, are multiplied and then replace the missing image regions. The number of multiplication here is dependent on the width of the transport elements 10' or regions covered thereby. When the width of the covered regions corresponds, for example, to a width of two sensor lines, the image region 15 lying in each case below a transport element 10' is doubled and inserted into the position of the respective transport element 10' in the corrected image. The second area value can be reliably estimated on the basis of an image corrected in this manner.

Alternatively, however, it can also be preferred to arrange the at least one ultrasonic sensor in a place where the banknotes are not covered by transport elements.

The invention claimed is:

1. An apparatus for checking value documents having at least one first sensor, which is configured to detect electromagnetic radiation reflected and/or transmitted by a value document and to convert said radiation into corresponding first sensor signals, and at least one second sensor, which is configured to detect sound waves reflected and/or transmitted by the value document and to convert said waves into corresponding second sensor signals, and an evaluation device, which is configured to determine a first area value characterizing a first area of the value document on the basis of the first sensor signals, to determine a second area value characterizing a second area of the value document on the basis of the second sensor signals, and to infer a possible identification marking of the value document with a marking ink on the basis of the first and second area values.

2. The apparatus according to claim 1, wherein the evaluation device is configured to infer an identification marking of the value document with a marking ink when the difference between the second area value and the first area value exceeds a predetermined first value.

3. The apparatus according to claim 1, wherein the evaluation device is configured to infer an identification marking of the value document with a marking ink when the quotient of the second area value and the first area value exceeds a predetermined second value.

4. The apparatus according to claim 1, wherein the evaluation device is configured to infer an identification marking of the value document with a marking ink when a relative deviation of the second area value from the first area value exceeds a predetermined third value.

5. The apparatus according to claim 4, wherein the evaluation device is configured to predetermine the first, second or third value in dependence on the denomination of the value document.

6. The apparatus according to claim 1, wherein the evaluation device is configured to infer an identification marking of the value document with marking ink on the basis of the first sensor signals which are obtained from the electromagnetic radiation reflected and/or transmitted in at least one edge region of the value document.

7. The apparatus according to claim 1, wherein the evaluation device is configured to infer an identification marking of the value document with marking ink on the basis of the first sensor signals which are obtained from the electromagnetic radiation reflected and/or transmitted in at least one predetermined region of the value document.

8. The apparatus according to claim 7, wherein the evaluation device is configured to predetermine the at least one predetermined region in dependence on the denomination of the value document.

9. The apparatus according to claim 1 with one or several transport elements, in particular transport belts, which are configured to transport the value document relative to the second sensor, wherein the transport elements cover one or several first regions of the value document, and wherein the evaluation device is configured to determine by estimation the second area value on the basis of the second sensor signals which are obtained from the sound waves reflected and/or transmitted in the one or several second regions of the value document which are not covered by the transport elements.

10. The apparatus according to claim 1, wherein the at least one first sensor is configured to detect electromagnetic radiation in the infrared range of the spectrum and to convert said radiation into the corresponding first sensor signals.

11. A method for checking value documents having the following steps of:

detecting electromagnetic radiation reflected and/or transmitted by a value document, and converting the detected electromagnetic radiation into corresponding first sensor signals, detecting sound waves reflected and/or transmitted by the value document, and converting the detected sound waves into corresponding second sensor signals, determining a first area value characterizing a first area of the value document on the basis of the first sensor signals, determining a second area value characterizing a second area of the value document on the basis of the second sensor signals, and determining whether the value document is possibly marked with a marking ink on the basis of the first and second area values.

* * * * *